US007810172B2

(12) United States Patent
Williams

(10) Patent No.: US 7,810,172 B2
(45) Date of Patent: Oct. 12, 2010

(54) GARMENT FOR ACCOMODATING MEDICAL DEVICES

(76) Inventor: Jody D. Williams, 5312 Catch Fly Ct., Columbia, MD (US) 21045

( * ) Notice: Subject to any disclaimer, the term of this patent is extended or adjusted under 35 U.S.C. 154(b) by 623 days.

(21) Appl. No.: 11/432,257

(22) Filed: May 11, 2006

(65) Prior Publication Data

US 2006/0253953 A1 Nov. 16, 2006

Related U.S. Application Data

(60) Provisional application No. 60/680,618, filed on May 13, 2005, provisional application No. 60/727,896, filed on Oct. 18, 2005.

(51) Int. Cl.
*A41B 9/00* (2006.01)
*A41D 10/00* (2006.01)

(52) U.S. Cl. ..... 2/114

(58) Field of Classification Search ..... 2/114, 2/111, 104, 80, 247, 69, 75, 78.2
See application file for complete search history.

(56) References Cited

U.S. PATENT DOCUMENTS

| | | | | | |
|---|---|---|---|---|---|
| 695,496 | A | * | 3/1902 | Schermerhorn | 2/114 |
| 818,351 | A | * | 4/1906 | Clark | 2/114 |
| 1,095,476 | A | * | 5/1914 | Sprague | 2/80 |
| 1,512,171 | A | * | 10/1924 | Homling | 2/78.2 |
| 1,626,024 | A | * | 4/1927 | Crane | 2/71 |
| 1,758,740 | A | * | 5/1930 | Gale | 2/78.2 |
| 1,766,272 | A | * | 6/1930 | Vallier | 2/114 |
| 1,792,610 | A | * | 2/1931 | Skinner | 2/75 |
| 1,797,604 | A | * | 3/1931 | Burgdorfer | 2/75 |
| 2,008,773 | A | * | 7/1935 | Shapiro | 2/80 |
| 2,652,057 | A | * | 9/1953 | Siegel et al. | 604/394 |
| 2,661,472 | A | * | 12/1953 | Miller | 2/74 |
| 2,704,070 | A | * | 3/1955 | Rudisill | 450/113 |
| 2,738,512 | A | * | 3/1956 | Winer | 2/80 |
| 2,896,633 | A | * | 7/1959 | McKee | 450/102 |
| 2,918,677 | A | * | 12/1959 | Pindyck | 2/111 |
| 2,922,164 | A | * | 1/1960 | Liff | 2/49.2 |
| 3,568,213 | A | * | 3/1971 | Mason | 2/80 |
| 3,746,602 | A | * | 7/1973 | Caroli et al. | 428/52 |
| 4,280,230 | A | * | 7/1981 | LaFleur | 2/408 |
| 4,502,155 | A | * | 3/1985 | Itoi | 2/115 |
| 4,578,062 | A | * | 3/1986 | Schneider | 604/174 |

(Continued)

*Primary Examiner*—Gary L Welch
*Assistant Examiner*—Amber R Anderson
(74) *Attorney, Agent, or Firm*—Lewinski Law Group LLC; Lynda Kouroupis

(57) ABSTRACT

A garment for accommodating medical devices comprises a garment panel detachably coupled to a garment body. The garment panel contains a concealed pocket suitable for accommodating one or more medical devices. The garment panel is detachable from the garment body at predetermined attachment zones which provide access to device sites and permit complete detachment of the garment panel. The panel may also be fixed to the garment body at anchor zones, while allowing decoupling at attachment zones. The pocket may contain an inner compartment for receiving a supplemental material such as an absorbing or deodorizing material. Apertures to the inner compartment allow the supplemental material to proximate device sites on the patient body or medical apparatus stored in the pocket. Stabilizers positioned on the interior of the garment may be used to secure medical monitor wires, tubing, or other devices. The garment is intended for wear by children and adults.

59 Claims, 6 Drawing Sheets

U.S. PATENT DOCUMENTS 4,582,508 A * 4/1986 Pavelka ..... 604/179
4,666,432 A * 5/1987 McNeish et al. ..... 604/174
4,688,270 A * 8/1987 Denicola et al. ..... 2/102
4,698,848 A * 10/1987 Buckley ..... 2/114
4,719,650 A * 1/1988 Milloy ..... 2/49.1
4,754,500 A * 7/1988 Brucato et al. ..... 2/105
4,759,083 A * 7/1988 Belcher ..... 2/114
4,961,234 A * 10/1990 Leibman ..... 2/234
5,048,122 A * 9/1991 Prieur ..... 2/69
5,063,614 A * 11/1991 McSheffery ..... 2/94
5,097,536 A * 3/1992 Cohen ..... 2/114
5,142,702 A 9/1992 Piloian
5,163,184 A * 11/1992 Reardon ..... 2/237
5,257,956 A * 11/1993 Ewen ..... 450/1
5,440,763 A * 8/1995 Shah et al. ..... 2/114
5,454,119 A * 10/1995 Thomm ..... 2/114
5,509,147 A * 4/1996 Busquets ..... 2/253
5,572,742 A * 11/1996 McFadden ..... 2/114
5,611,086 A * 3/1997 Eggen ..... 2/104
5,628,064 A * 5/1997 Chung ..... 2/70
5,894,600 A * 4/1999 Chenefront ..... 2/69
5,946,725 A * 9/1999 Shatzkin et al. ..... 2/106
5,994,612 A * 11/1999 Watkins ..... 602/41
6,032,287 A * 3/2000 Kallas ..... 2/69
6,032,289 A * 3/2000 Villapiano ..... 2/102
6,055,668 A * 5/2000 Gros et al. ..... 2/69
6,154,883 A * 12/2000 Spann et al. ..... 2/69
6,282,717 B1 * 9/2001 Ng ..... 2/70
6,421,834 B2 * 7/2002 Kester ..... 2/94
6,460,187 B1 * 10/2002 Siegel ..... 2/114
6,477,710 B1 11/2002 Ojoyeyi
6,647,552 B1 * 11/2003 Hogan ..... 2/114
D495,468 S * 9/2004 Wheeler-Dickson et al. . D2/720
7,000,261 B1 * 2/2006 Loffredo ..... 2/400
7,073,204 B1 * 7/2006 Boyles ..... 2/114
D530,885 S * 10/2006 Barthel ..... D2/720
7,117,539 B1 * 10/2006 Baacke ..... 2/102
7,165,271 B2 * 1/2007 Elen ..... 2/85
7,181,773 B1 * 2/2007 Piraka ..... 2/114
2003/0126668 A1 * 7/2003 Scroggins ..... 2/114
2003/0177563 A1 * 9/2003 Reich ..... 2/75
2004/0226073 A1 11/2004 McCullar
2005/0055755 A1 * 3/2005 Smith ..... 2/405
2005/0235394 A1 * 10/2005 Pew ..... 2/111
2006/0156450 A1 * 7/2006 McGrath ..... 2/114

* cited by examiner

GARMENT FOR ACCOMODATING MEDICAL DEVICES

CROSS-REFERENCE TO RELATED APPLICATIONS

This application claims priority to U.S. Provisional Application No. 60/680,618 filed on May 13, 2005, and to U.S. Provisional Application No. 60/727,896 filed on Oct. 18, 2005, which are entirely incorporated herein by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF INVENTION

This invention relates in general to garments for patients who rely on intrusive medical devices. In particular, the invention relates to garments suitable for the accommodation of medical devices such as central venous catheters, gastronomy tubes, ostomy bags, bile bags, medical monitors and other devices.

As medical technology advances, greater numbers of patients are living longer with critical health problems. For health conditions in which the body cannot perform essential functions such as eating, filtering bile, or eliminating waste, surgical procedures combined with external medical devices can be used to assist and facilitate those functions. Depending on the patient's condition, one or several devices may be required on either a temporary or permanent basis.

Many of the medical conditions that warrant the use of such devices occur in the very early stages of life. In the year 2002 alone, 480,812 births in the United States were classified as premature, meaning that birth occurred prior to 37 weeks gestation. A majority of the health problems encountered by premature infants are due to the immature development of the organ systems. When a child is born with an underdeveloped gastrointestinal system, oral feeding is not possible. In those cases, a gastronomy tube, otherwise referred to as a feeding tube or G-tube, is surgically implanted, with one end of the tube inserted into the stomach through an incision near the navel and the other end extending externally. Adequate nourishment, as well as medication, can be administered through the G-tube. Once the G-tube is surgically implanted it remains in place as long as it is required by the patient.

Premature infants are not the only patients that utilize G-tubes. Children born with cerebral palsy, muscular dystrophy, or urea cycle disorders may experience swallowing difficulties that necessitate the use of the device. For some patients the feeding tube may be in place only temporarily until the ability to swallow is learned or returns. Sadly, however, many patients cannot learn to swallow, so the G-tube must remain in the patient permanently.

Not all G-tube patients are children or adults suffering from conditions present at birth. Many adults find themselves confronted with the need for a feeding tube later in life due to an accident, illness or stroke. Regardless of patient age or required use duration, proper maintenance of the G-tube is critical to patient health. The G-tube and insertion site should be kept clean from leaking fluids or soiling so as to preclude infection. Furthermore the G-tube should be protected from accidental or intentional pulling, jerking, or dislodging.

A device that is structurally similar to the G-tube is the central venous catheter (CVC), otherwise known as a central line. Often used by cancer victims or other chronically ill patients, the CVC is a flexible tube surgically inserted into the patient so that one endpoint is in a large vein leading to the heart and the other endpoint extends out of the body through a small exit aperture in the chest area. The central line is designed to allow bi-directional fluid flow. When used as an input device, medications and fluids can be administered and blood products transfused. As an output device, the CVC can be used to withdraw blood samples, so as to eliminate the need for repeated puncturing of veins in other areas of the body such as the arms, hands or legs. The CVC and exit site should be kept clean and dry to prevent infection. As with the G-tube described above, the central line should not be pulled, tugged or dislodged. If the line is jerked out of position, not only may the patient experience considerable pain, but he may also be compelled to undergo a surgical procedure to reposition the catheter.

Another device surgically adapted to a patient is a billiary catheter, otherwise referred to as a T-tube. To prevent the harmful accumulation of bile in the liver of a patient whose bile ducts are blocked, a percutaneous billiary drainage procedure is performed in which a billiary catheter is inserted through the skin into the bile ducts. Bile then drains from the liver through the T-tube to an external storage pouch known as a bile bag. The T-tube insertion site should be kept clean and dry to prevent infection and the tubing and bag should be secured in a manner that protects against accidental dislodging of the T-tube or puncturing or detachment of the bile bag. Patients are advised to secure the bile bag to their legs or pin them to their clothes.

A further example of an intrusive medical device is the ostomy bag used by patients who have undergone either a colostomy or an ileostomy. These procedures are performed on patients with bowel infections, obstructions, inflammations or injuries, as well as those with Crohn's disease or cancer. A portion of the intestine is removed, and the bottom of the remaining intestine is surgically pulled out of the body via a stoma or opening in the abdominal wall. It is then turned down and sutured to the skin around the stoma. A drainage pouch or bag known as an ostomy bag is attached to the opening to accommodate the drainage of waste from the intestine. In many cases the ostomy bag is designed to adhere to the body around the stoma. There are also ostomy bags designed to accept fluid flow from the stoma through a catheter. Proper maintenance requires that the ostomy bag be changed as necessary, and the stoma site kept clean and dry to protect against bacterial infection. Furthermore, the ostomy bag should be secured to prevent dislodgment, as well as to protect against damage to the ostomy bag or detachment of the bag from the stoma.

A final example of a medical device that may be worn by a patient is a medical monitor, such as a cardiac monitor or blood oxygen content monitor. Sensors attached to particular sites on the patient provide status information that is transmitted electronically to a display unit. Because the electrical wiring associated with the sensors may be quite lengthy, care should be exercised to prevent tangling of the wires.

The list above is not intended to be exhaustive, but is instead merely illustrative of the diversity of devices on which a patient may depend. From the examples discussed, it is evident that patients with a variety of ailments and conditions require medical devices; and that medical devices vary greatly in size, weight, and appearance. Some patients may be sufficiently ill so as to be confined in a hospital or long-term care facility. Others may remain bedridden at home. Conversely, some patients may be well enough to lead active, normal lives. Regardless of the individual patient condition, the patient and his health care providers should protect the insertion sites and the devices, yet make the patient as comfortable as possible. Tubing extending from the body can be bothersome as well as vulnerable to pulling and twisting. Pouches containing drainage fluid can feel bulky and heavy and generally uncomfortable. In addition to the physical discomfort there is also the psychological anxiety that the pouch will be perceived by the general public, or even worse, that the pouch will become dislodged and detached.

In general, patients utilizing these devices wear conventional clothing appropriate for their individual conditions, i.e. a hospital gown, simple undergarments, pajamas, or street clothes. Hospital gowns may allow easy access to the devices by the patient and his health care providers but afford the patient little or no modesty, comfort or warmth. Rare is the patient who is not somewhat self-conscious visiting with guests while clothed only in a hospital gown. Conversely, street clothes afford the patient more privacy, but may make access to the devices difficult or cumbersome. The difficulty is compounded for patients in nursing homes who lack mobility or whose size makes movement difficult even with assistance.

Patients who have resumed a fairly normal lifestyle and who mingle with the general public may prefer to remain discrete regarding their condition. For many patients, as well as their families and caregivers, it is important for the patient to appear "normal" and not attract attention due to the presence of medical devices, especially those considered unsightly, such as ostomy bags, which can also be odorous. Since it can greatly affect psychological well-being, a semblance of normalcy can be a significant factor in a patient's health. However, when these patients dress according to societal norms, they often find their professional attire or conventional daywear uncomfortable or ill-suited for the devices that must accompany them at all times.

Whether hospital attire or personal clothing is worn, most garments do not provide support or security for the medical devices, rather they offer some degree of concealment. There is a need for garments suitable for male and female patients of all ages that are adapted to accommodate intrusive medical devices so as to provide modesty for the patient, security for the medical devices, and access to the patient and the devices by medical personnel and the patient.

There is a need for a garment that can accommodate a variety of medical devices, ranging from extended flexible tubing to relatively large drainage and storage pouches. Many patients with health problems find they require more than one type of medical device. In the year 2002, twelve percent of births in the United States were premature. Advances in medical technology allow the majority of premature infants to survive, however many will experience complications which will require the short-term or long-term use of intrusive medical devices. Premature infants with underdeveloped organ systems may require a G-tube as well as an ostomy bag and central line. Likewise, patients with chronic diseases such as colon cancer may require both a central line for chemotherapy and blood products, as well as an ostomy bag for waste elimination if a portion of the intestine is removed.

There is a further need for a garment adapted for medical devices that can be easily donned by patients of all ages. Because it is important to keep device sites clean and dry, when a patient's garment becomes either wet or soiled, it should be changed. Consequently, the clothing of an infant with intrusive medical devices may have to be changed several times a day. Infants need garments which can be put on or taken off with a minimum amount of effort by the caregiver and minimal discomfort to the infant. The easier the garment is to put on, the shorter the changing time and the lower the risk that the infant will pull, jerk, dislodge or detach the medical device. Likewise, there is a need for a garment which will accommodate a variety of medical devices but will not interfere with changing an infant's soiled diaper. Because infants require diaper changes at regular intervals, there is a need for a garment which facilitates frequent diaper changes without necessitating frequent rearrangement of the patient's medical devices.

Similarly, for older patients who are confined to a bed or a wheelchair, there is a need for a garment which will accommodate medical devices, but which can easily be changed if the garment is soiled. This is especially important for those patients whose size or disability makes it difficult for caregivers to lift or move the patients. In recognition of the fact that older adults often become incontinent, there is a need for an adult garment adapted for medical devices that does not impede the changing of adult underpads.

There is a need for a garment that can accommodate medical devices as well as provide easy access to the insertion sites as well as the devices themselves. The exit port for a central line, the insertion site for a G-tube or billiary catheter, and the stoma site resulting from a colostomy or ileostomy can become infected if not properly maintained. The sites should be kept clean and dry, and, as in the case of the central line site, the bandage should be changed at regular intervals as well as when the area becomes wet or soiled. There is a need for a garment which facilitates access to device sites so that their status can be checked and proper care provided.

There is a need for a garment suitable for the accommodation of medical devices that allows for an outward appearance of conformity with the general public, so that the patient's medical condition is not overtly obvious. The garment should provide security for the devices while discreetly concealing their presence and affording the patient a degree of normalcy in regard to attire and appearance.

Finally, there is a need for a garment suitable for the accommodation of medical devices that facilitates the care and maintenance of the device site. G-tube sites are prone to leakage, yet should be kept clean and dry. There is a need for a garment that provides a means for keeping the site areas dry so as to reduce the risk of infection. There is also a need for a garment that provides for the elimination or masking of unpleasant odors.

Several garments in the prior art have attempted to address these needs. U.S. Pat. No. 5,048,122 to Prieur discloses a garment for shielding lines connected to a patient. The Prieur garment is intended for patients with an embedded catheter. The garment has a close-fitting body with a pocket on the inside surface of the garment at the site of the implanted catheter in which the catheter may be stored. U.S. Pat. No. 5,142,702 to Piloian discloses an upper body ostomy garment. The Piloian garment is loose-fitting at the waist and has an interior pocket for holding an ostomy appliance. Finally, U.S. Pat. No. 6,477,710 to Ojoyeyi teaches a garment for concealing patient medical devices. The garment has one or more hidden pockets on the inside surface of the front of the garment for holding a medical appliance. When an appliance is deployed it is withdrawn from the pocket and pulled out through an opening to the exterior of the garment.

While adequate for their intended purposes, the cited prior art leaves several of the previously expressed needs unanswered. The pocket of the Prieur garment is well-suited for the storage of a central venous catheter; however, because the garment is tight-fitting so as to secure the catheter, the garment as a whole is not amenable to the storage of bodily fluid bags such as ostomy or bile bags. Similarly, the pocket of the Piloian garment suffices for holding an ostomy bag, but is unsatisfactory for housing a central line catheter due to the location of the pocket. The Ojoyeyi garment, while having multiple pockets in a variety of locations on the front of the garment so as to house multiple devices, is primarily suited for appliances such as catheters and medical monitors with tubing and wires that can be coiled for storage then straightened when extracted through an opening to the outside of the garment. Thus, none of the cited garments sufficiently addresses the need for a garment which accommodates and conceals multiple medical appliances of various types.

Furthermore, the prior art garments do not answer the need for a garment that is not only easily donned and removed, but is also appropriate for patients ages ranging from infant to geriatric. The Prieur and Ojoyeyi garments, worn by infants as sleepers, require arms to be extracted and the entire garment pulled down the patient and removed when any portion of the garment is soiled to the extent that a change of dress is warranted. The Piloian garment, worn as a shirt, separates in the front for removal. While somewhat easier to remove, the style is less suited for infant wear, requires that arms must be slipped through sleeves, and requires the entire garment to be taken off when any portion of it becomes soiled or wet.

The aforementioned prior art garments do not answer the need for a garment that provides easy access to device sites on infant patients. Neither of the garments suitable for infant wear provides easy access to device sites for quick inspection and care of the site. The Prieur garment holds a catheter in an interior pocket on the front of the garment, but the opening of the garment is located away from the pocket so as to discourage access to the device by the infant. The Ojoyeyi garment provides easy access to the devices themselves via apertures by which the device can be extracted, but the apertures do not provide a means by which the device site can be inspected.

SUMMARY OF THE INVENTION

The present invention provides a garment for accommodating medical devices comprising a garment body detachably coupled to a panel containing a concealed pocket for accommodating a medical device. The panel is detachably coupled to the garment body at a plurality of attachment zones at predetermined locations so as to allow easy access to a device site, thus facilitating the examination, care and maintenance of the site. Detachment of the panel from the garment body provides access to the patient torso and crotch areas, and allows the garment to be easily donned by patients of all ages. The invention may include an auxiliary compartment for receiving a supplemental material such as absorption or deodorizing material. Apertures in the auxiliary compartment can allow the supplemental material to be proximate device sites so as to absorb fluid leakage, or pocket contents so as to mask unpleasant odors. The panel may also be coupled to the garment body in a manner which allows for decoupling in some attachment zones and fixed attachment in other zones so that the panel may be decoupled from the garment body to allow access to device sites and pocket content without complete detachment from the garment body. Front portions of the garment body can be decoupled so that the garment is easily donned by patients.

BRIEF DESCRIPTION OF THE DRAWINGS

Embodiments of the present invention will be described, by way of example, with reference to the accompanying drawings, wherein.

DETAILED DESCRIPTION OF INVENTION

Figure 1:
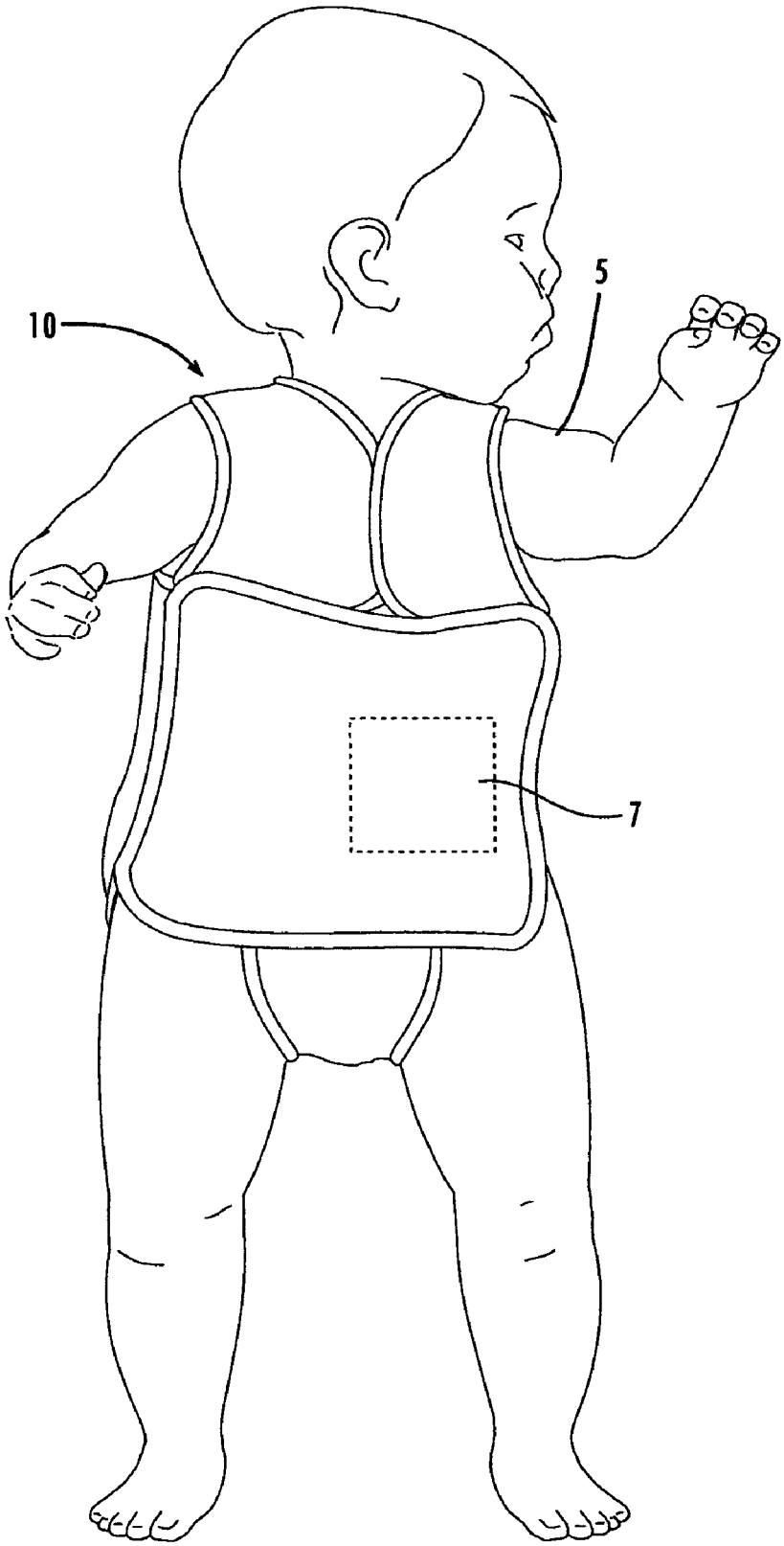
FIG. 1 depicts a patient wearing a garment in accordance with an exemplary embodiment of the invention.

The drawings referenced herein are provided to assist in the understanding of the invention. It is noted however, that the drawings are not drawn to scale, and that the dimensions of particular elements may vary. Referring to the drawings, where like elements are denoted by like numbers throughout, FIG. 1 shows a patient 5 fitted with a medical device 7, such as a G-tube, and clothed with an embodiment of the invention 10. The exterior appearance of the garment 10 is similar to that of an infant jumper and masks the presence of the medical device. The garment 10 is suitable for infant playwear as well as an infant undergarment. The medical device is secured within the garment 10 so as to prevent infant access. The garment 10 may also be worn by children and adult patients as an undergarment. The garment 10 may be made of a variety of materials; however the applicant has found that cotton works well since it is a natural, breathable fabric that is comfortable to wear as an undergarment, daywear or sleepwear.

Figure 2:
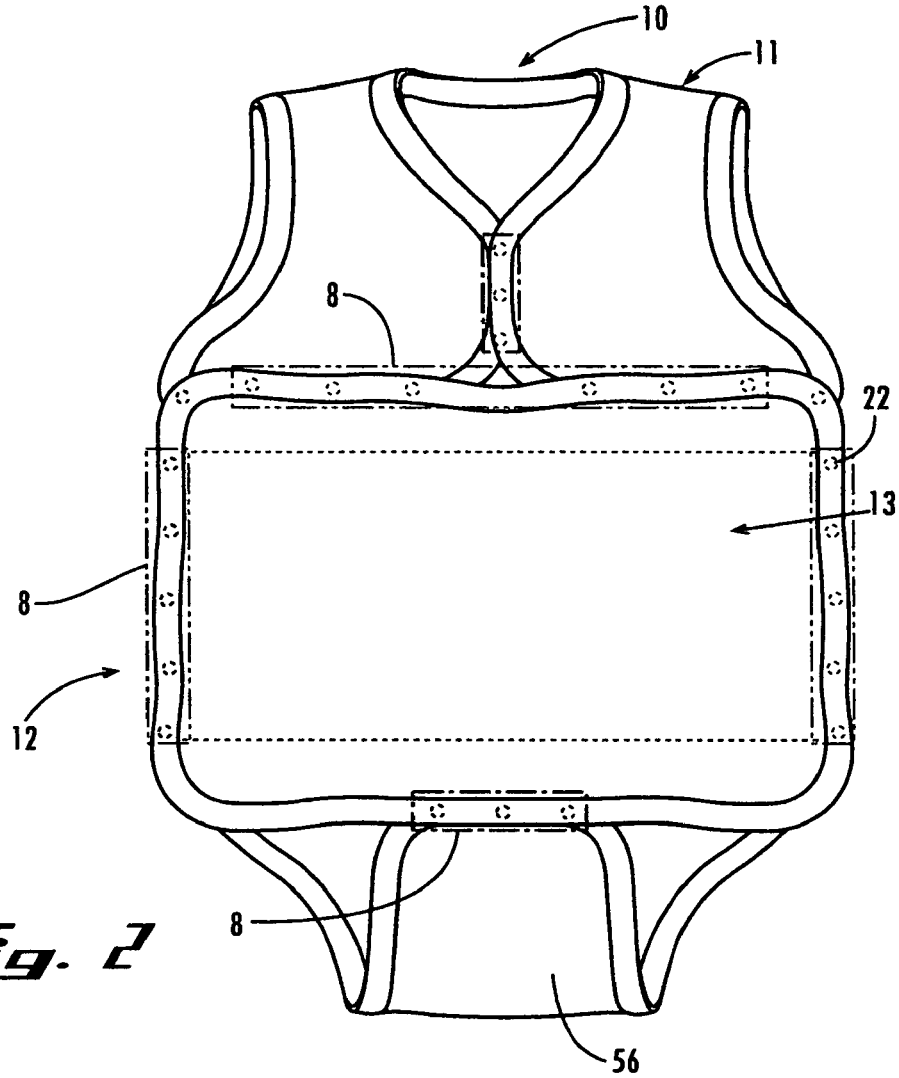
FIG. 2 depicts a garment in accordance with an exemplary embodiment of the invention.
Figure 4:
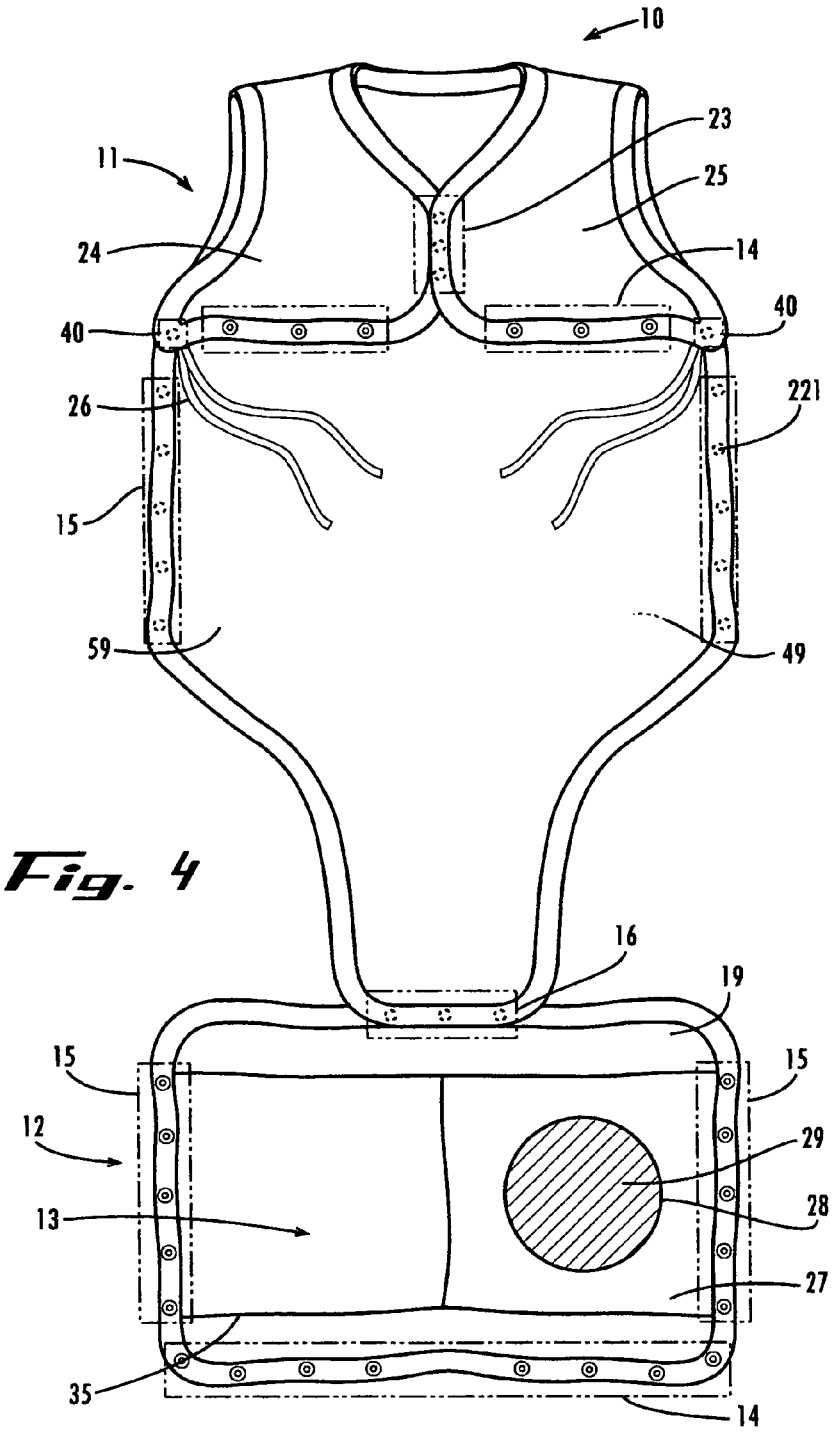
FIG. 4 shows a garment in accordance with the invention in which a portion of the garment is partially detached.

FIG. 2 shows the garment 10 of FIG. 1 in greater detail. The garment 10 is shown with a garment body 11 and a garment panel 12. A pocket 13 for accommodating medical devices is formed on the interior face 19 of the garment panel 12, as shown in FIG. 4, so is concealed from view. The pocket 13 is of sufficient size to secure one or more of a variety of medical appliances, including, by way of example but not of limitation, a G-tube, an ostomy bag, a bile bag, a catheter or a medical monitor. Because the pocket 13 is located on the interior face 19 of the garment panel 12, the pocket 13 and its contents are concealed, affording the patient a modicum of discretion about his condition. In addition, the pocket 13 contents are protected against inadvertent or intentional pulling, jerking or dislodging by the patient or others.

Figure 3B:
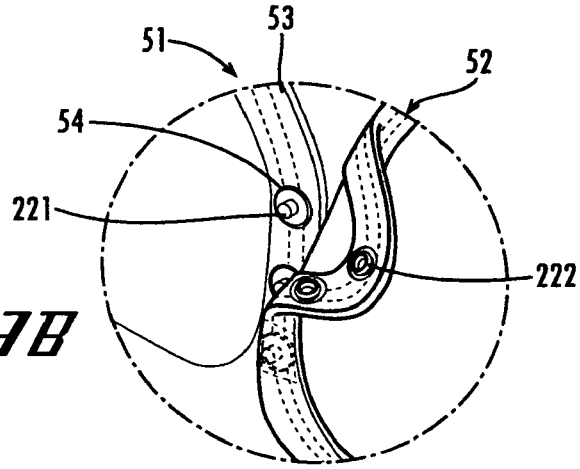
FIG. 3B shows an exemplary embodiment of the invention.
Figure 3A:
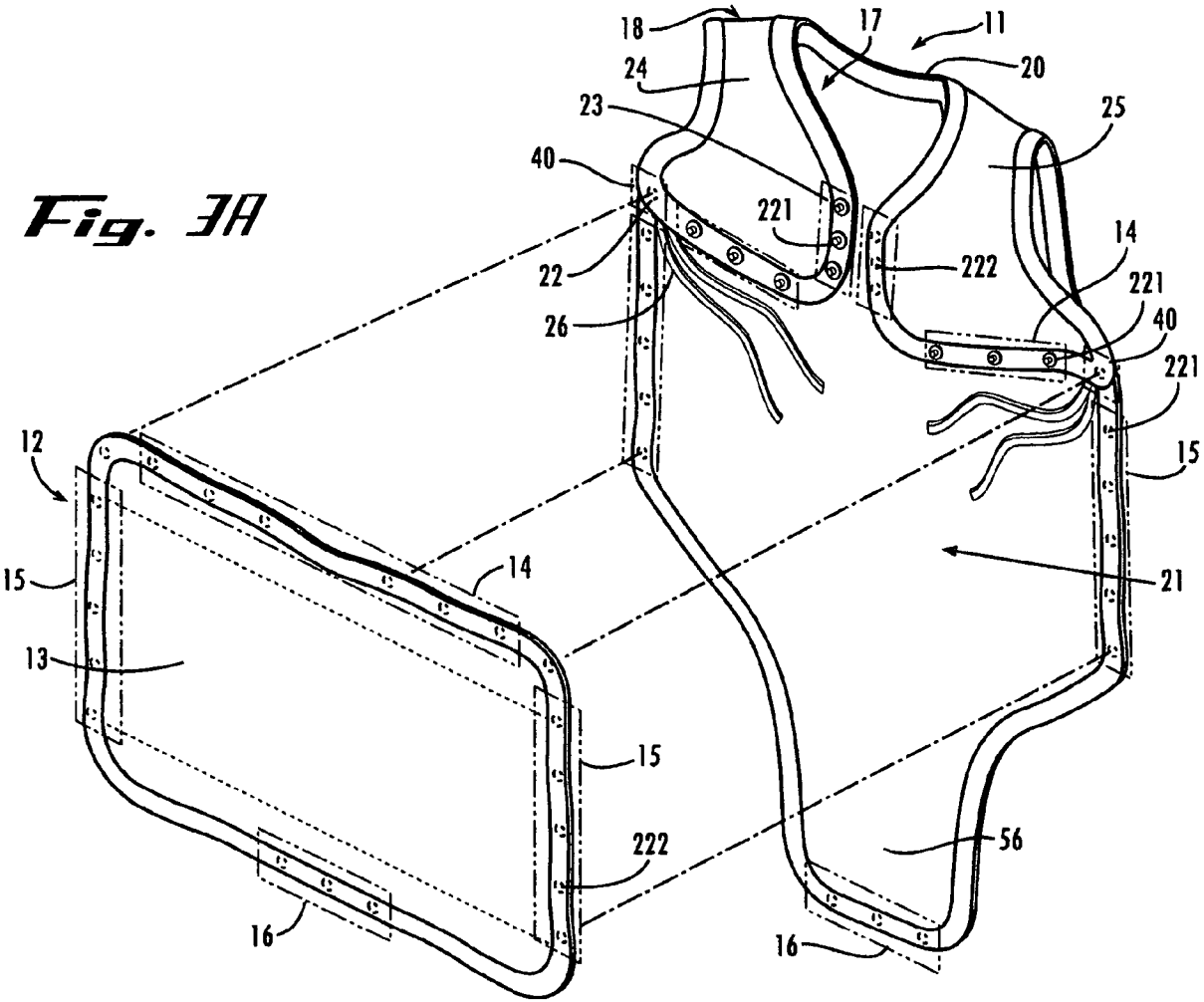
FIG. 3A depicts a garment in accordance with the invention in which a portion of the garment has been detached.

The garment panel 12 is detachably coupled to the garment body 11 at one or more predetermined attachment zones 8. The predetermined attachment zones 8 may extend around the entire perimeter of the garment panel 12 or extend only along select portions of the perimeter. The location of the predetermined attachment zones 8 can allow access to device sites as well as permitting detachment of the garment panel 12 from the garment body 11. A garment in accordance with the invention may have at least one predetermined attachment zone 8 that is an upper attachment zone 14 located along the upper edge of the garment panel 12, as shown in FIG. 3A. When the garment panel 12 is detached from the garment body 11 at the upper attachment zone 14 the chest of the patient may be exposed, allowing access to device sites such as, but not limited to, an exit port for a central line, or an attachment site for a cardiac monitor. The sites may be inspected without requiring removal of the entire garment 10 or rearrangement of the medical devices stored in the pocket 13. The upper attachment zone 14 may extend across the width of the garment panel 12 so as to allow partial or complete detachment of the upper edge of the garment panel 12 from the garment body 11 at the upper attachment zone 14.

A garment in accordance with the invention may have at least one predetermined attachment zone 8 that is a side attachment zone 15 located near a side edge of the garment panel 12. The side attachment zones 15 permit the garment panel 12 to be detached from the garment body 11 at the torso of the patient, so as to allow inspection of device sites located in this region of the body, for example, a stoma for an ostomy bag or an incision for a T-tube or a G-tube. Devices sites on the lower torso of the body can be examined without requiring the entire garment to be removed, medical devices repositioned, or the upper chest of the patient unnecessarily exposed. In addition to facilitating an examination of the patient, detachment of the garment panel 12 from the garment body 11 at the side attachment zones 15 provides additional modesty for the adult patient, and prevents younger patients from disturbing their medical appliances during an examination.

A garment in accordance with the invention may have at least one predetermined attachment zone 8 that is a crotch attachment zone 16 wherein the garment panel 12 is detachably coupled to a crotch portion 56 of the garment body 11. Coupling of the garment panel 12 to the garment body 11 at the crotch attachment zone 16 keeps the garment 10 securely positioned on the patient and prevents slippage around the patient's waist. It also keeps the diaper area concealed for both infant and adult patients. Decoupling the garment panel 12 from the garment body 11 at the crotch attachment zone 16 allows diaper changes to be performed easily without requiring the garment 10 to be pulled off the body or the medical devices rearranged. While changing an infant's diaper, decoupling at the crotch attachment zone 16 allows the rest of the garment 10 to remain in place so that the pocket 13 contents remain protected and concealed from the patient. Similarly, an adult patient's underpad may be changed without removing the garment 10 or disturbing the medical devices attached to the patient.

FIG. 3A depicts the garment 10 of FIG. 2 wherein the garment panel 12 has been completely detached from the garment body 11 by decoupling at all the predetermined attachment zones 8. As shown in FIG. 3A, the garment body 11 has a back portion 17 which generally covers the patient's back area and is connected to a front portion 18 which covers a portion of the patient's front area. An opening 21 provides access to the patient's body.

As shown in FIG. 2, releasable fasteners 22 are positioned within the predetermined attachment zones 8 so as to couple and decouple the garment body 11 and the garment panel 12. Referring to FIG. 3A, the releasable fasteners 22 can include a first fastener portion 221 and a second fastener portion 222 whereby the first fastener portion 221 and the second fastener portion 222 are adapted for releasable engagement. The first fastener portions 221 can be positioned in the predetermined attachment zones 8, such as the upper attachment zone 14, the side attachment zones 15, and the crotch attachment zone 16 located on the garment body 11, and the complementing second fastener portion 222 can be located in the corresponding predetermined attachment zones 8 on the garment panel 12 so that the garment body 11 and the garment panel 12 may be detachably coupled. By way of example, and not of limitation, the releasable fasteners 22 can include buttons, wherein the first fastener portions 221 are buttons and the second fastener portions 222 are buttonholes; conventional hook and loop tape such as Velcro™, wherein the first fastener portion 221 is hook tape and the second fastener portion 222 is loop tape; snaps, wherein the first fastener portion 221 is a male portion and the second fastener portion 222 is a female portion; hooks and eyes, wherein the first fastener portion 221 is a hook and the second fastener portion 222 is an eye. The releasable fasteners 22 can also include any other type of fasteners, or combination thereof, which can be releasably engaged. In the exemplary embodiment shown in FIG. 3A, the first portion 221 is depicted as a male portion of a snap.

The applicant has found that plastic snaps are well-suited for use as the releasable fasteners 22. The plastic snaps protect patients with nickel allergies from contact with nickel alloys that may be present in metal snaps. Patients with nickel allergies may develop itchy skin rashes when the skin is in contact with a nickel-containing compound. Because device sites should be kept clean and dry, a rash that urges the patient to scratch in the device environs could be very troublesome and uncomfortable for the patient, as well as detrimental to the condition of the site. The use of plastic snaps helps avoid such a complication. The use of plastic snaps also allows the garment to be worn during patient x-rays, eliminating the need to disrobe the patient prior to administering an x-ray examination.

Plastic snap tape, which consists of a strip of material on which first or second portions of plastic snaps are arranged, can be used to facilitate the manufacturing process. In an exemplary embodiment, a first length of plastic snap tape 51, as shown in FIG. 3B, containing an arrangement of the first fastener portions 221 of plastic snaps is positioned at a predetermined attachment zone 8 on garment body 11 and a second length of plastic snap tape 52, containing an arrangement of the second fastener portions 222 of plastic snaps is positioned at a corresponding predetermined attachment zone 8 on the garment panel 12, so that the garment panel 12 can be coupled to the garment body 11 by engaging the first and second fastener portions 221, 222 of the plastic snaps on the first and second lengths of plastic snap tape 51, 52. As shown in FIG. 3B, the first length of plastic snap tape 51 can be positioned at the predetermined attachment zone 8 within a seamed casing 53 that extends around the perimeter of the garment body 11. Apertures 54 on a surface of the casing 53 at the predetermined attachment zone 8 on the garment body 11 expose the first fastener portions 221 of the plastic snaps. Likewise, the apertures 54 can be formed on a surface of the casing 53 at the predetermined attachment zones 8 on the garment panel 12 to expose the second fastener portions 222 of the plastic snaps so that the first and second fastener portions 221, 222 of the plastic snaps can releasably engage to couple the garment body 11 to the garment panel 12. Housing the first and second fastener portions 221, 222 of the plastic snaps in the casing 53 protects them during the laundering process, particularly if the laundering is performed at an industrial facility. It is noted that in FIGS. 3A and 4, the first fastener portion 221 of the releasable fasteners 22 on the garment body 11 located in the side attachment zones 15 are exposed on the rear surface 49 of the garment body 11. The rear surface 49 can be turned toward the front of the garment body 11 when coupling the garment body 11 to the garment panel 12 so that the exposed first fastener portion 221 of the releasable fasteners 22 can engage the exposed second fastener portion 222 of releasable fasteners 22 on the garment panel 12. A garment body and panel in accordance with the invention may have edges that are serged, hemmed, or otherwise finished without a seamed casing. Accordingly, the first and second fastener portions 221 and 222 of the releasable fasteners 22 can be positioned and exposed in the predetermined attachment zones 8 without being contained within a casing. Similarly, the predetermined attachment zones 8 and the first fastener portions 221 of the releasable fasteners 22 can be positioned on either a front surface 59 or the rear surface 49 of the garment body 11 so long as they can engage the second fastener portions 222 of the releasable fasteners 22 on the garment body 12.

As mentioned above, device sites should be kept clean and dry; therefore, when the patient's clothing becomes wet or soiled it should be changed. Because the garment panel 12 is completely detachable from the garment body 11, soiling of a portion of the garment 10 does not require that the entire garment 10 be removed. As shown in FIG. 3A, if the garment panel 12 becomes wet or soiled, it can be completely detached from the garment body 11 by decoupling at all the predetermined attachment zones 8 so that a dry garment panel 12 may coupled to the garment body 11. This is an additional advantage of the invention over garments in the prior art. The easy exchange allows the garment body 11 to remain on the patient, decreasing the time necessary to conduct the change as well as reducing the effort required by the caregiver and mitigating the trouble experienced by the patient. This feature is especially advantageous when the patient is a young child or an older patient with limited mobility. The easy removal of the garment panel 12 also makes the garment 10 more economical than conventional patient attire since a single garment body 11 may be worn an entire day even when it is necessary to change the garment panel 12 several times a day. Thus both clothing purchasing and laundering costs can be reduced since multiple garment panels 12 can be used with a single garment body 11. Similarly, soiling of the garment body 11 does not require that the entire garment 10 be changed. The current garment panel 12 can simply be decoupled from the garment body 11, the soiled garment body 11 removed from the patient, a clean garment body 11 placed on the patient, and the current garment panel 12 attached to the clean garment body 11.

In the exemplary embodiment depicted in FIG. 3A, the garment body 11 has a predetermined front attachment zone 23 to allow a first front subportion 24 of the garment front portion 18 to be detachably coupled to a second front subportion 25 of the front portion 18. A neckline 20 can define a neckhole that encircles a patient's neck. The releasable fasteners 22, as described in detail above, may be positioned within the front attachment zone 23, with the first fastener portion 221 of the releasable fastener 22 located on the first front subportion 24, and the second fastener portion 222 of the releasable fasteners 22 located on the second front subportion 25 so that the first and second fastener portions 221, 222 of the releasable fasteners 22 can engage. The front attachment zone 23 allows the garment body 11 to be completely opened so as to expose the entire torso of the patient when the garment panel 12 is detached.

Figure 6:
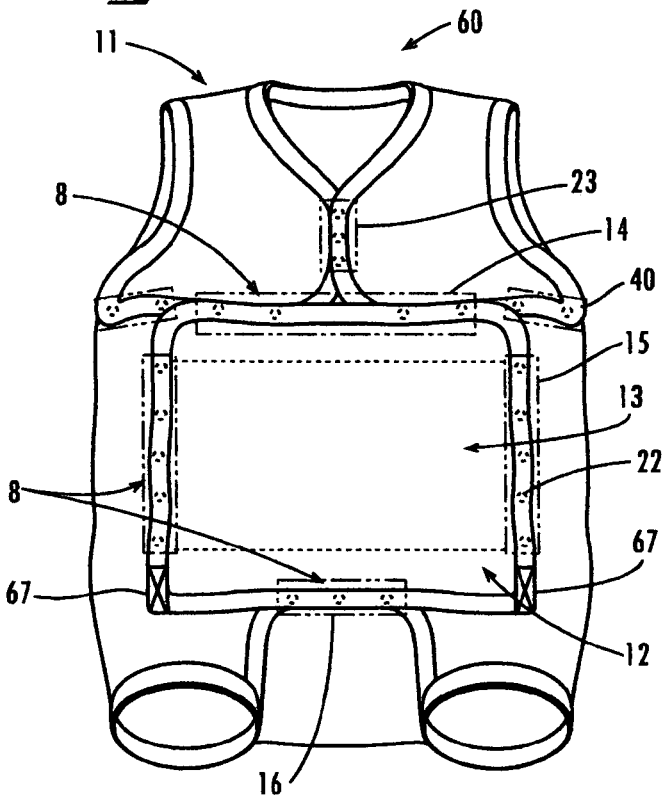
FIG. 6 shows a garment in accordance with a further embodiment of the invention.

FIG. 3A shows two predetermined underarm attachment zones 40 at which releasable fasteners 22 are positioned. The releasable fasteners 22 may be positioned at the underarm attachment zone 40 with the first fastener portion 221 of the releasable fastener 22 positioned on the back portion 17 and the second fastener portion 222 of the releasable fastener 22 positioned on the front portion 18 of the garment body 11 so that the first and second fastener portions 221, 222 of the releasable fastener 22 may be releasably engaged under the wearer's arm. A garment in accordance with this embodiment can be positioned and fastened on a patient without requiring the patient to force his or her arm through an armhole, and without requiring that the garment body 11 be pulled over the patient's head. Instead, the garment body 11 may be placed around the shoulders of the patient, and the releasable fasteners 22 at the front attachment zone 23 and the releasable fasteners 22 at the underarm attachment zone 40 engaged to secure the garment body 11 on the patient. The garment panel 12 can then be coupled to the garment body 11. A further embodiment of the invention may have armholes defined by openings in garment body 11 without an underarm attachment zone 40, in which case a patient would slip her arms through the armholes when dressing. It is noted that the side attachment zones 15 of the exemplary embodiment depicted in FIG. 3A are located at the sides of the garment body 11 so as to extend along the sides of the patient rather than on the front of the patient body. The size and positioning of the at least one upper attachment zone 14 and side attachment zone 15 may vary to accommodate patient and manufacturing needs. For example, side attachment zones 15 may be positioned as shown in FIG. 6.

Because the garment panel 12 may be completely detachable from the garment body 11, and the first front subportion 24 may be detachable from the second front subportion 25 of the garment body 11, and the front portion 18 may be detachable from the back portion 17 at the underarm attachment zone 40, the garment 10 may be easily donned by patients of all ages. It is a distinct advantage of the invention that the garment 10 need not be pulled over the head, arms, or legs when dressing a patient, or when disrobing. When dressing, the garment panel 12 can first be attached to the garment body 11 at the crotch attachment zone 16, and the crotch portion 56 of the garment body 11 appropriately positioned under the patient. The garment body 11 may placed around the back and shoulders of the patient and the first and second fastener portions 221, 222 of the releasable fasteners 22 engaged at the underarm attachment zone 40. The first front subportion 24 of the garment body 11 may be detachably coupled to the second front subportion 25 at the front attachment zone 23. The garment panel 12 may then be coupled to the garment body 11 at some portion of the side attachment zones 15. At this stage in the dressing procedure the patient's medical devices may be inserted into the pocket 13, then the garment panel 12 may be coupled to the garment body 11 at any remaining portion of the side attachment zones 15 and the upper attachment zone 14. This manner of donning a garment in accordance with the invention is particularly useful when dressing an infant or an older patient with limited mobility. For older patients confined to wheelchairs or beds, the garment body 11 can be slipped around the patient's back and arms while the patient is in a sitting position or lifted slightly, then the garment panel 12 attached. As can be gleaned from the figures, there are several methods to don the garment; the particular method used by a patient may be selected to suit the patient's own individual needs and preferences. Because the garment 10 of the invention can be put on and removed from the patient without having to be pulled over the patient's head, arms, or legs, the garment 10 can also be worn by patients that are equipped with a halo due to a spinal injury, or those in a Pavlik harness due to hip dysplasia.

A garment in accordance with the invention may include device stabilizers 26 as shown in FIG. 3A. The stabilizers 26 are used to secure medical devices such as catheter tubing, monitor wires, or other devices to prevent movement and may be used to keep the devices to the side so as to discourage toying with the devices by the patient. The stabilizers 26 may comprise strips of material that can be used to tie around and/or otherwise secure wires, tubing, or other medical devices. The stabilizers 26 may be sewn to the interior of the garment body 11 at an underarm location as shown in FIG. 3A. It is noted, however, that stabilizers 26 may be positioned in alternate locations on the garment 10. The stabilizers 26 may extend to the interior of garment 10 to avoid snagging by objects around the patient and to discourage unintentional pulling by the patient or caregiver. Depending on the manner in which the stabilizers 26 are employed, devices secured by the stabilizers 26 may remain secured when the garment panel 12 is removed, thus the garment panel 12 may be exchanged without having to reposition the secured devices, and the patient and caregiver are less likely to disturb the devices during an examination.

FIG. 4 depicts the garment 10 in accordance with the invention wherein the garment panel 12 is detached from the garment body 11 at the upper attachment zone 14 and the side attachment zones 15, yet remains attached to the garment body 11 at the crotch attachment zone 16. In this view, the garment panel 12 is turned down and extended so that the interior face 19 of the garment panel 12 is exposed and the garment panel 12 appears upside down. The interior face 19 of the garment panel 12 is shown in FIG. 4, revealing the pocket 13 which may be used to accommodate one or more medical devices. The pocket 13 is accessible via an opening along edge 35 where the edge 35 is not attached to the garment panel 12. The pocket 13 can extend across the entire width of garment panel 12 so as to provide ample storage space for a variety of medical devices, or may extend across a limited portion of garment panel 12 width. A garment in accordance with the invention can contain an auxiliary compartment 27 with an aperture 28 by which a supplemental material 29 may be received. The aperture 28 may be formed so as to allow the supplemental material 29 to be in close proximity or contact with a device site on the patient body. For example, if the patient is fitted with a G-tube, the supplemental material 29 may be an absorption material that absorbs fluid leakage around the G-tube site.

Figure 5:
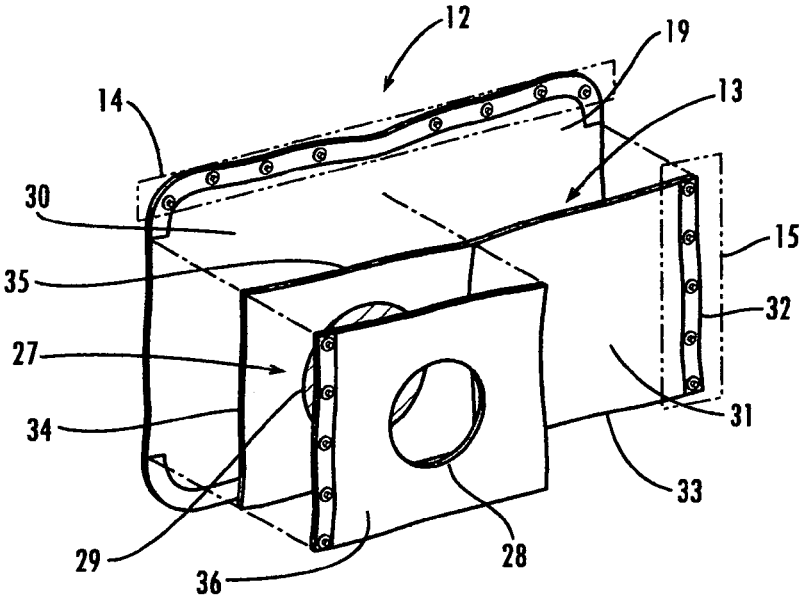
FIG. 5 shows a garment panel in accordance with the invention.

FIG. 5 shows the structure of the garment panel 12 in greater detail. Some components of garment panel 12 are shown separated to better illustrate the manner in which the garment panel 12 is constructed. In this view, the detached garment panel 12 of FIG. 3 is rotated around so as to expose the interior face 19 of the garment panel 12, with the upper attachment zone 14 at the top. In an exemplary embodiment, the garment panel 12 can comprise a base 30 to which a first layer of material 31 is attached. The first layer of material 31 can be attached to the base 30 at a first side 32, a second side 33 and a third side 34 of the first layer of material 31. The pocket 13 is defined as the space between the base 30 and the first layer of material 31. The upper edge 35 of the first layer of material 31 may be completely unattached to the base 30 so as to provide an opening across the entire width of the first layer 31 by which the pocket 13 may receive one or more medical devices of various sizes. Alternatively, some portion less than the entire width of upper edge 35 of first layer 31 may be unattached to the base 30 to attain a desired size for the pocket 13, so long as the pocket 13 is accessible.

In an exemplary embodiment, first layer 31 is stitched or serged to the base 30 at the first side 32, the second side 33 and the third side 34. By sewing the first layer 31 to the base 30, the pocket 13 can be secured so that the first layer 31 is not prone to accidental separation from the base 30. Thus the pocket 13 may securely accommodate one or more bulky medical devices, and offers both concealment and support of the medical devices received therein. The patient need not worry that that the pocket 13 will inadvertently come apart and expose the stored devices, or worse yet, release them. However, in lieu of stitched seams, other means of attachment known in the art, including but not limited to buttons, snaps, and hook and loop tape, may be employed to attach the first layer 31 to the base 30.

In a garment according to the invention, multiple pockets can be formed by providing additional seams or fasteners that couple the first layer 31 to the base 30 or by providing additional layers of fabric that can be attached to the base 30 to form one or more additional pockets. A pocket lining (not shown) may be provided within the pocket 13 to protect the pocket 13 from becoming wet or soiled from leaky devices accommodated within the pocket 13. The lining may be detachably coupled to the pocket 13 to allow for easy exchange of the lining, or may be sewn or otherwise attached to the pocket 13. In a further embodiment of the invention, a pocket can be formed independently of the garment panel 12, and then coupled to the panel 12. For example, a pocket may be formed separately from the garment panel 12 and then sewn, adhered, or otherwise coupled to the garment panel 12.

As shown in FIGS. 4 and 5, the garment panel 12 can include the auxiliary compartment 27. The auxiliary compartment 27 can be formed by attaching a second layer 36 of material to the first layer 31. The auxiliary compartment 27 is defined as the space between the first layer 31 and the second layer 36. The second layer 36 can be stitched to the first layer 31 around some portion of or the entirety of the perimeter of the second layer 36. Alternatively, the second layer 36 can be attached to the first layer 31 by some other coupling means such as, but not limited to buttons, snaps, or hook and loop tape. The aperture 28 can be formed in the second layer 36 by which the supplemental material 29 may be received by the auxiliary compartment 27. The aperture 28 formed in the second layer 36 can allow the received supplemental material 29 to be exposed to and proximate to and/or in contact with a device site on the patient body. This is particularly helpful for patients with device sites such as stomas and G-tube incisions which are prone to leakage. Keeping device sites clean and dry is an important factor in the care and maintenance of the sites. Patients with device sites that are prone to leakage may insert an absorbing material as the supplemental material 29, which may, via the aperture 28, be in contact with or proximate to a device site in order to absorb fluid around the site. The applicant has found that a conventional nursing pad performs well as a supplemental material for fluid absorption. However, depending on the needs of the patient, other materials may be used, such as materials designed and treated to deodorize, sanitize, or sterilize an insertion point or medical device. The aperture 28, shown as generally circular in FIGS. 4 and 5, may be of any size and shape so as to allow the supplemental material 29 to be exposed to and near or in contact with a device site on the patient. When the supplemental material 29 becomes wet or soiled, it is easily extracted via the aperture 28 and exchanged without disrupting the positioning of the devices contained within the pocket 13.

Alternatively, the aperture 28 can be formed in the first layer 31 by which the supplemental material 29 can be proximate the contents of the pocket 13. A patient with an ostomy bag or bile bag, which may exude an unpleasant odor, may wish to insert a deodorizing or sanitizing material as supplemental material 29. In this case, the supplemental material 29 need not touch the medical device housed in pocket 13 so long as it is near or proximate, since it may deodorize pocket 13 contents without direct contact. In a further embodiment, a garment in accordance with the invention may have an aperture 29 formed in both the first layer 31 and the second layer 36 so that the supplemental material 29 is proximate a device site on a patient as well as proximate to apparatus stored in pocket 13.

The garment 10 as depicted in FIGS. 1-5 is particularly useful as an undergarment for children or adults. Conventional clothing may be worn over the garment 10 so that the presence of devices is concealed and the patient is not self-conscious about his appearance. Since any portion of the patient torso area can be exposed by selectively detaching the garment panel 12 from the garment body 11, as well as the first front subportion 24 from the second front subportion 25 at the appropriate predetermined attachment zones 8 and the front attachment zone 23, respectively, a patient can be examined by a health care provider without having to completely disrobe, thus affording the patient some degree of modesty. The illustrated embodiments may also be suitable for infant playwear or sleepwear or hospital wear for children or adults.

FIGS. 1-5 show the garment panel 12 as completely detachable from the garment body 11. FIG. 6 shows a garment 60 in accordance with the invention in which the garment panel 12 is detachably coupled to the garment body 11 at the predetermined attachment zones 8 by the releasable fasteners 22. However, the garment panel 12 is fixed, for example by stitching, to the garment body 11 at the anchor zones 67, which, in the garment 60, are located at the bottom corners of the garment panel 12, but may be variously positioned. In this embodiment, the garment panel 12 may be uncoupled from the garment body 11 at the upper and side attachment zones 14 and 15, but the garment panel 12 is not completely detachable. By uncoupling the garment panel 12 from the garment body 11, the torso of the patient is accessible as well as the contents of the pocket 13. The predetermined attachment zones 8 can extend along selected portions of the perimeter of garment panel 12 so as to allow access to device sites on the patient as well as to contents of pocket 13. The embodiment 60 can also contain the auxiliary compartment 27 and the aperture 28 for receiving the supplementary material 29, as previously discussed herein, though not shown in FIG. 6. The garment 60 includes the underarm attachment zone 40 in which the releasable fasteners 22 can be engaged; alternative embodiments may forego the underarm attachment zone 40. Similarly, the side attachment zones 15 may be variously positioned on the garment; for example, they may extend generally under the arm and along the sides of the patient.

Figure 7:
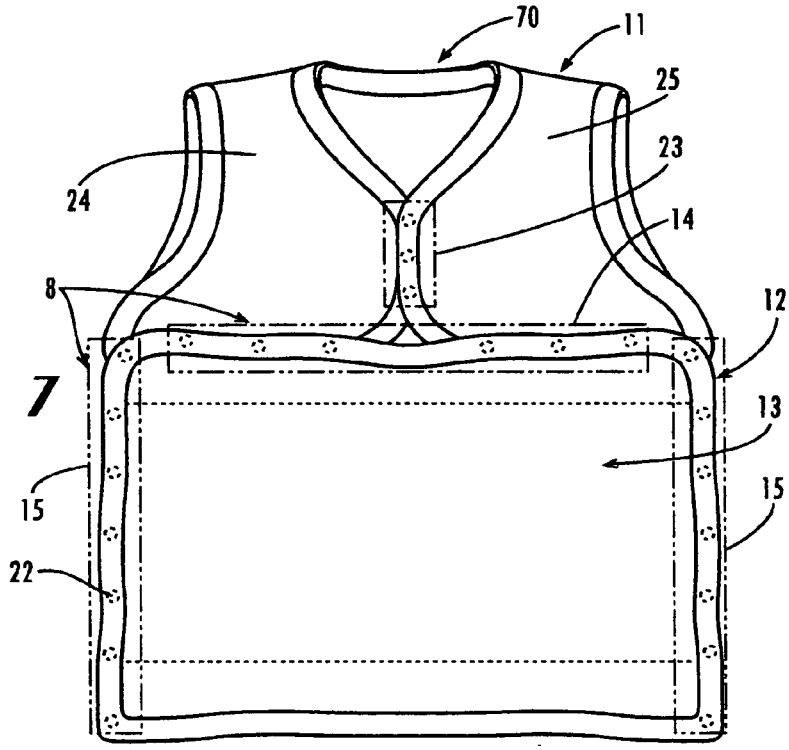
FIG. 7 depicts a garment in accordance with a further embodiment of the invention.

A further embodiment 70 of the present invention is shown in FIG. 7. In this embodiment the garment 70 is intended to be worn as a shirt or top garment rather than an undergarment. While providing one or more predetermined attachment zones 8 for coupling and decoupling the garment panel 12 from the garment body 11, such as at least one upper attachment zone 14 and one or more side attachment zones 15, the garment body 11 does not have a crotch portion 56; and neither the garment body 11 nor the garment panel 12 has the crotch attachment zone 16. The predetermined attachment zones 8 may extend around the perimeter of garment panel 12 as shown in FIG. 7 to allow access to device sites on the patient as well as to the contents of the pocket 13. The releasable fasteners 22 are arranged at the predetermined attachment zones 8 so that the garment panel 12 may be detachably coupled to the garment body 11. The garment 70 can have the front attachment zone 23 which allows the first front subportion 24 of the garment body 11 to be detachably coupled to the second front subportion 25 of the garment body 11 so that the entire torso of the wearer is accessible when garment panel 12 is detached from the garment body 11. As shown in the example embodiment of FIG. 7, the first and second from subportions 24 and 25 can cover the wearer's breasts, providing modesty for the patient should the garment panel 12 be uncoupled at upper attachment zone 14. This embodiment is well-suited for casual wear; accordingly, the garment 70 may be made of conventional fabrics such as cotton, polyester, or blends thereof. The exterior appearance of garment 70 resembles a conventional tank top. The embodiment 70 may have the auxiliary compartment 27 and the aperture 28 for receiving the supplementary material 29 as previously discussed herein, though not shown in FIG. 7. The garment 70 can have at least one underarm attachment zone 40 (not shown). A further embodiment of the invention may include armholes formed in the garment body 11 without the underarm attachment zone 40.

Figure 8:
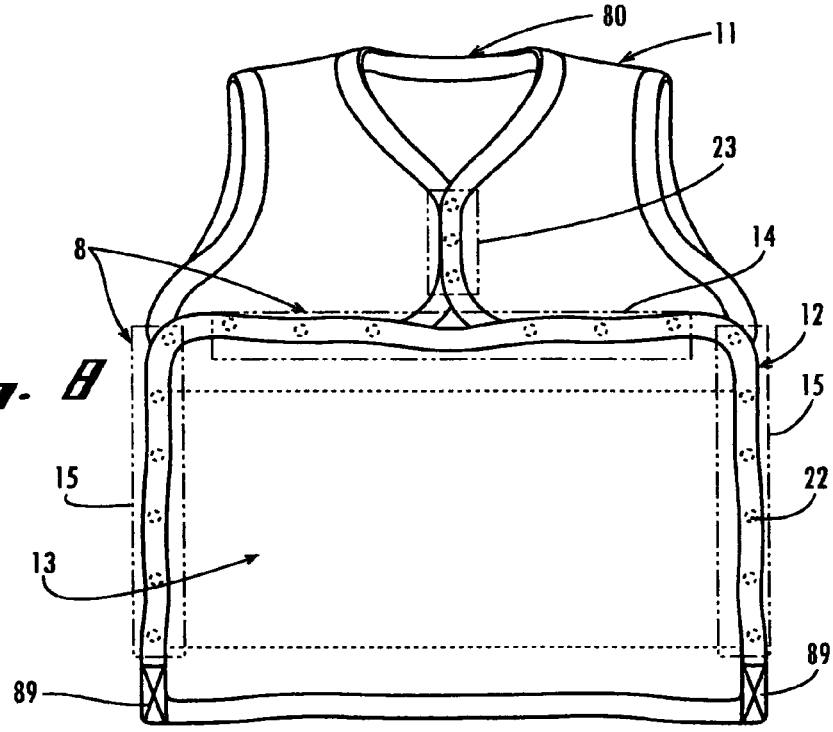
FIG. 8 shows a garment in accordance with a further embodiment of the invention.

FIG. 8 depicts a garment 80 in accordance with the invention in which the garment panel 12 is detachably coupled to the garment body 11 at the predetermined attachment zones 8 but fixed to the garment body 11 at one or more anchor zones 89. The garment panel 12 may be fixed of the garment body 11 at the anchor zones 89 by sewing or by other means. The garment panel 12 of the garment 80 may be uncoupled from the garment body 11 at the predetermined attachment zones 8, but is not completely detachable. The releasable fasteners 22 are arranged at the predetermined attachment zones 8 so that the garment panel 12 may be detachably coupled to the garment body 11. The garment 80 can have the front attachment zone 23 which allows the first front subportion 24 of the garment body 11 to be detachably coupled to the second front subportion 25 of garment body 11 so that the entire torso of the wearer is accessible when the garment panel 12 is uncoupled from the garment body 11. The anchor zones 89 may be located anywhere on the garment panel 12 and the garment body 11 so as to fix the garment panel 12 to the garment body 11 and still allow decoupling of the garment panel 12 from the garment body 11 at the predetermined attachment zones 8 so that device sites and the contents of the pocket 13 can be accessed. The garment 80 can also contain the auxiliary compartment 27 and the aperture 28 for receiving the supplementary material 29 as previously discussed herein, though not shown in FIG. 8. Likewise, the garment 80 can have at least one underarm attachment zone 40 (not shown). It is noted that although illustrated as sleeveless in FIGS. 1-8, a garment in accordance with the invention may have a garment body 11 with at least one sleeve portion that covers an arm of a wearer. The sleeve portion can include at least one predetermined sleeve attachment zone. At least one releasable fastener 22 can be positioned in the predetermined sleeve attachment zone so that the sleeve portion of the garment body 11 can be placed over the arm of a wearer and the releasable fastener 22 fastened to form a sleeve. The first fastener portion 221 and the second fastener portion 222 of the releasable fastener 22 can be positioned on the sleeve portion in a manner that allows releasable engagement so that a sleeve can be formed. Thus, a wearer can don the garment body 11 without having to poke an arm through a sleeve.

In addition to enhancing physical health, physical activity has been demonstrated to improve mental function and emotional well-being. The embodiments illustrated in FIGS. 7 and 8 are particularly useful as athletic apparel for patients with medical devices. Accordingly, in exemplary embodiments, garments 70 and 80 are made of wicking material designed to wick moisture away from the body so that perspiration does not negatively affect device sites. Patients may be more likely to engage in physical activity, exercise and competitive sports when they have attire that will secure and support their medical devices as well as help protect and maintain device sites by wicking moisture away from the skin.

Explicit details and figures are disclosed herein to provide a clear understanding of the invention; however, modifications and variations will be apparent to those skilled in the art. For example, the size and positioning of the various predetermined attachment zones and releasable fasteners may vary with patient, manufacturing, or other considerations. Likewise, the length and width of the interior pocket for storing medical devices may vary. Overlapping garment portions and subportions may be variously positioned as to which is above or beneath another. Other alterations and variations may occur to those skilled in the art without departing from the scope of the appended claims.

What is claimed is:

1. A garment, comprising:

a garment body having a back portion for covering a wearer's back, a front portion for covering a wearer's chest region, said front portion comprising first and second front subportions detachably coupled one to another, said first front subportion for covering a first portion of said wearer's chest region and said second front subportion for covering a second portion of said wearer's chest region, and a crotch portion extending from said back portion through the legs of said wearer to cover said wearer's crotch region;

a single panel having on its interior face a pocket for accommodating at least one medical device, said panel detachably coupled to said first and second front subportions and said crotch portion, said panel configured to extend across a width of said wearer's front torso region below said front portion without covering said wearer's crotch region, said panel completely separable from said garment body; and wherein decoupling said garment panel from said garment body directly exposes said wearer's body.

2. The garment of claim 1, wherein said panel is detachably coupled to said garment body at one or more predetermined attachment zones.

3. The garment of claim 2, wherein at least one predetermined attachment zone is provided at a device site.

4. The garment of claim 2, wherein at least one predetermined attachment zone is provided at said crotch portion of the garment body.

5. The garment of claim 3, further comprising at least one releasable fastener located at said predetermined attachment zone.

6. The garment of claim 5, wherein said releasable fastener is a plastic snap.

7. A garment, as claimed in claim 2, further comprising at least one first fastener portion located on said garment body at said predetermined attachment zone and at least one second fastener portion located on said panel at said predetermined attachment zone, said first fastener portion and said second fastener portion adapted to releasably engage so that said panel can detachably couple to said garment body.

8. A garment, as claimed in claim 1, wherein said panel includes an auxiliary compartment for receiving a supplemental material.

9. A garment, as claimed in claim 8, wherein said auxiliary compartment includes an aperture for receiving said supplemental material.

10. The garment of claim 9, wherein said aperture is provided at a predetermined location such that said supplemental material is proximate a device site.

11. The garment of claim 9, wherein said aperture is provided at a predetermined location such that said supplemental material is proximate the contents of said pocket.

12. A garment, as claimed in claim 1, further comprising device stabilizers.

13. A garment, as claimed in claim 1, wherein said garment body and said panel are made of a wicking material adapted to wick moisture away from said wearer's body.

14. A garment body, comprising:

a back portion for covering a wearer's back;

a front portion for covering a wearer's chest region, said front portion comprising a first front subportion for covering a first portion of said wearer's chest region and a second front subportion for covering a second portion of said wearer's chest region, each subportion having a first predetermined attachment zone for detachably coupling said front subportions one to another, and having a second predetermined attachment zone for detachably coupling a single garment panel;

a crotch portion for covering said wearer's crotch region, said crotch portion extending from said back portion through the legs of said wearer and having a crotch attachment zone for detachably coupling said single garment panel;

wherein said front portion and said crotch portion are completely separable from said single garment panel;

wherein, said garment body exposes a front torso region of the wearer's body below said detachably coupled front subportions;

wherein said front subportions and said crotch portion are configured to detachably couple to said single garment panel so that said single garment panel extends across said wearer's body to conceal said front torso region of the wearer's body exposed by the garment body without covering said crotch region of said wearer; and wherein decoupling said garment panel from said front portion exposes said wearer's body.

15. A garment body, as claimed in claim 14, wherein each of said predetermined attachment zones comprises at least one releasable fastener.

16. A garment body, as claimed in claim 15, wherein said at least one releasable fastener is a plastic snap.

17. A garment body, as claimed in claim 14, wherein at least one of said predetermined attachment zones is located at a device site.

18. A garment body, as claimed in claim 14, further comprising device stabilizers for securing a medical device.

19. A garment body, as claimed in claim 14, made of a wicking material.

20. A garment body, as claimed in claim 14, further comprising a sleeve portion.

21. A garment body, as claimed in claim 20, further comprising a sleeve attachment zone.

22. A garment body, as claimed in claim 21, further comprising at least one releasable fastener at said sleeve attachment zone.

23. The garment body of claim 14, further comprising at least one predetermined underarm attachment zone with a releasable fastener adapted to detachably couple said back portion to said front portion to form an armhole.

24. A garment body comprising:

a back portion for covering a wearer's back;

a front portion for covering a wearer's chest region, said front portion comprising a first front subportion for covering a first breast of said wearer and a second front subportion for covering a second breast of said wearer, each front subportion having a first predetermined attachment zone for detachably coupling said front subportions one to another, and a second predetermined attachment zone for detachably coupling a single garment panel, said first and second front subportions detachably coupled one to another in a manner that allows said front portion to be completely opened;

wherein said garment body exposes a front torso region of the wearer's body above said wearer's waist below said coupled front subportions;

wherein said front subportions and said back portion are configured to detachably couple to said single garment panel so that said single garment panel extends across said wearer's body, without coverings said wearer's crotch region, to conceal said front torso region of the wearer's body exposed by said garment body; and wherein decoupling said garment panel from said garment body exposes said wearer's body.

25. A garment body, as claimed in claim 24, wherein each of said predetermined attachment zones comprises at least one releasable fastener.

26. A garment body, as claimed in claim 25, wherein said releasable fastener is a plastic snap.

27. A garment body, as claimed in claim 24, further comprising a neckhole adapted to enclose a neck of a wearer.

28. A garment body, as claimed in claim 24, further comprising device stabilizers.

29. A garment body, as claimed in claim 24, made of a wicking material.

30. The garment body of claim 24, further comprising an underarm attachment zone for detachably coupling said front portion to said back portion to form an armhole.

31. A detachable garment panel, comprising:

a base having a predetermined attachment zone comprising a releasable fastener;

a pocket, comprising a first layer of fabric attached to said base, said pocket for accommodating a medical device;

an auxiliary compartment for receiving and storing a supplementary material, said auxiliary compartment comprising a second layer of fabric at least partially overlaying said first layer; and wherein said garment panel is configured to detachably couple to a garment body to extend across a front torso region of a wearer's body without covering a crotch region of said wearer's body, to conceal a portion of the wearer's body that is exposed by said garment body.

32. The detachable garment panel of claim 31, wherein said releasable fastener is a plastic snap.

33. A detachable garment panel, as claimed in claim 31, further comprising an aperture in said auxiliary compartment.

34. A detachable garment panel, as claimed in claim 33, wherein said aperture is adapted to allow said supplemental material to be proximate a device site.

35. A detachable garment panel, as claimed in claim 33, wherein said aperture is adapted to allow said supplemental material to be proximate the contents of said pocket.

36. The detachable garment panel of claim 31, wherein said panel is completely separable from said garment body.

37. A method of making a garment, comprising:

providing a garment body, said garment body having a back portion for covering a wearer's back, and a front portion for covering a wearer's chest region, said front portion comprising first and second front subportions detachably coupled one to another, said first front subportion for covering a first portion of said wearer's chest region and said second front subportion for covering a second portion of said wearer's chest region, said first and second front subportions each having a first predetermined attachment zone for detachably coupling said front subportions one to another and having a second predetermined attachment zone for detachably coupling a single garment panel, said garment body having a crotch portion configured to extend from said back portion through said wearer's legs to cover said wearer's crotch region;

wherein said garment body exposes a front torso region of the wearer's body above the wearer's waist below said detachably coupled front subportions;

wherein said front portion and said crotch portion are adapted to detachably couple said single panel which is adapted to extend across said wearer's front torso region below said first and second front subportions to conceal said front torso region of the wearer's body exposed by the garment body without covering said wearer's crotch region; and wherein decoupling said panel from said garment body exposes said wearer's body.

38. The method of claim 37, further comprising providing at least one anchor zone adapted to fix said garment panel to said garment body.

39. The method of claim 37, wherein said panel is completely removable from said garment body.

40. The method of claim 37, further comprising providing said single garment panel, said garment panel adapted to detachably couple to said first and second front subportions to extend below said front portion and across a width of said wearer's front torso region without covering said wearer's crotch region, wherein decoupling of said panel from said garment body directly exposes said wearer's body.

41. The method of claim 40, wherein said garment panel is completely separable from said garment body.

42. The method of claim 40, wherein said garment panel comprises a pocket on an interior face, said pocket for accommodating a medical device.

43. The method of claim 42, wherein said garment panel further comprises a compartment comprising a layer of fabric at least partially overlaying said pocket.

44. The method of claim 37, wherein said first and second front subportions are detachably coupled in a manner that allows said front portion to be completely opened.

45. A garment comprising:

a garment body having a back portion for covering a wearer's back, and a front portion to cover a wearer's chest region, said front portion comprising first and second front subportions detachably coupled one to another, said first front subportion for covering a first breast of said wearer, said second front subportion for covering a second breast of said wearer, said garment body exposing a front torso region of said wearer's body below said coupled first and second front subportions;

a single garment panel having a pocket on an interior face adapted to accommodate a medical device, said panel detachably coupled to said first and second front subportions and configured to extend across said wearer's front torso region below said first and second front subportions to conceal said front torso region of the wearer's body exposed by the garment body without covering said wearer's crotch region, said panel comprising a base, a first layer of fabric attached to said base to form said pocket, and an auxiliary compartment for receiving and storing a supplementary material, said auxiliary compartment comprising a second layer of fabric at least partially overlaying said first layer;

wherein each of said first and second front subportions has a first predetermined attachment zone for detachably coupling said front subportions one to another and a second predetermined attachment zone for detachably coupling said panel;

wherein said panel comprises &third predetermined attachment zone for detachably coupling said panel to said from portion; and wherein decoupling of said panel from said garment body directly exposes said wearer's body.

46. The garment of claim 45, wherein at least one of said predetermined attachment zones is provided at a device site.

47. The garment of claim 45, wherein said predetermined attachment zones comprise at least one releasable fastener.

48. A garment, as claimed in claim 45, further comprising at least one first fastener portion located on said garment body at one of said first and second predetermined attachment zones, and at least one second fastener portion located on said garment panel at said third predetermined attachment zone, wherein said first fastener portion and said second fastener portion fasteners are adapted to releasably engage so that said garment panel can detachably couple to said garment body.

49. A garment, as claimed in claim 45, wherein said auxiliary compartment comprises an aperture for receiving said supplemental material.

50. The garment of claim 49, wherein said aperture is provided at a predetermined location such that said supplemental material is proximate a device site of a wearer.

51. The garment of claim 49, wherein said aperture is provided at a predetermined location such that said supplemental material is proximate the contents of said pocket.

52. A garment, as claimed in claim 45, further comprising device stabilizers.

53. A garment, as claimed in claim 45, wherein said garment is made of wicking material.

54. The garment of claim 45, wherein said first and second front subportions are detachably coupled in a manner that allows said front portion to be completely opened.

55. The garment of claim 45, wherein said garment panel is coupled to said back portion of said garment body.

56. A garment, comprising:

a garment body having a back portion for covering a wearer's back, a crotch, portion through said wearer's leas to cover said wearer's crotch area, and a front portion for covering a wearer's chest region, said front portion comprising first and second front subportions detachably coupled one to another, said first front subportion for covering a first portion of said wearer's chest region, said second front subportion for covering a second portion of said wearer's chest region, said garment body exposing a front torso region of the wearer's body below said coupled first and second front subportions;

a single panel detachably coupled to said first and second front subportions, said panel configured to extend across the wearer's front torso region below said first and second front subportions without covering said wearer's crotch region;

wherein each of said front subportions has a first predetermined attachment zone for detachably coupling said front subportions one to another and a second predetermined attachment zone for detachably coupling said panel;

wherein said panel is completely removable from said garment body; and wherein decoupling of said panel from said garment body directly exposes said wearer's body.

57. The garment of claim 56, wherein said panel is adapted to provide access to a medical device site on a wearer.

58. The garment of claim 56, wherein said panel has a pocket.

59. The garment of claim 56, wherein said pocket is on an interior face of said panel.

* * * * *